United States Patent [19]

Turley

[11] 4,299,197

[45] Nov. 10, 1981

[54] HEAT RADIATING BURNER FOR USE IN FIREPLACES

[75] Inventor: Charles E. Turley, 8010 55th Pl., NE., Marysville, Wash. 98270

[73] Assignee: Charles E. Turley, Marysville, Wash.

[21] Appl. No.: 76,269

[22] Filed: Sep. 17, 1979

[51] Int. Cl.[3] ..... F23H 13/02

[52] U.S. Cl. ..... 126/165

[58] Field of Search ..... 126/152 R, 25 A, 163, 126/164, 165, 152 A, 152 B; 44/38, 40

[56] References Cited

U.S. PATENT DOCUMENTS

| | | | |
|---|---|---|---|
| 3,025,784 | 3/1962 | Williams | 126/165 |
| 3,175,549 | 3/1965 | Bergsten | 126/25 R |
| 3,182,585 | 5/1965 | Rensch et al. | 126/25 R |
| 3,832,989 | 9/1974 | Belford | 126/25 R |

*Primary Examiner*—James C. Yeung
*Attorney, Agent, or Firm*—Harvey B. Jacobson

[57] ABSTRACT

An upstanding panel assembly having a forwardly facing front side and upper and lower marginal edges interconnected at corresponding ends by upstanding opposite side marginal edges. The panel assembly is constructed of fireproof heat reflective material and a grill generally parallels the panel assembly and is supported from the latter in spaced relation forward of the front side thereof to define a narrow combustion chamber between the grill and the panel assembly. The grill includes lower and opposite side marginal portions extending between corresponding lower and side marginal edges of the grill and panel assembly thereby closing the lower and opposite side marginal portions of the combustion chamber. The combustion chamber opens upwardly between the upper marginal portions of the grill and panel assembly and may downwardly receive combustible solid fuel components such as cross-cut log sections of pressed wood fiber logs therein.

4 Claims, 3 Drawing Figures

HEAT RADIATING BURNER FOR USE IN FIREPLACES

BACKGROUND OF THE INVENTION

Various forms of grills have been heretofore provided for burning combustible materials such as charcoal, coal, wood logs and pressed wood fiber logs. Some of these grills include combustion chambers constructed, primarily, of expanded metal or similar mesh material and are capable of sustaining only reasonably complete combustion of the combustible material placed therein. Further, although conventional fireplaces provide combustion chambers in which log wood and other combustible materials such as coal, charcoal and pressed wood fiber logs may be burned, fireplaces do not enable such solid fuels to be burned efficiently. Accordingly, and particularly with the increased importance upon natural energy conservation, a need exists for a combustion chamber for use in a conventional fireplace and which may be utilized to efficiently burn solid fuel.

Examples of several different forms of structures in which various types of solid fuels may be burned and which include some of the general structural and operational features of the instant invention are disclosed in U.S. Pat. Nos. 659,770, 757,595, 3,285,238, 3,389,651, 3,421,433, 3,742,838, 3,783,855 and 3,832,989. However, these previously known structures are not specifically designed for efficient burning of solid fuels within conventional fireplace structures.

BRIEF DESCRIPTION OF THE INVENTION

The heater of the instant invention is to be utilized within a conventional fireplace or other fireplace-type combustion chamber forming structure and includes an upstanding inclined panel assembly constructed of fireproof and heat resistant material. The panel assembly is slightly inclined and includes a front face which faces outwardly in an upwardly inclined direction. An expanded metal panel including opposite side and lower marginal edge right angularly disposed flanges is supported from the panel assembly in spaced relation relative to the front side or face thereof and defines a combustion chamber immediately forwardly of the front face of the panel assembly in which cross-cut wood log sections or pressed wood log sections may be placed for burning. The combustion chamber opens upwardly between the upper marginal portions of the expanded metal panel and the panel assembly and, accordingly, cross-cut sections of solid log-type fuel may be dropped down into the combustion chamber for burning therein on top of cross-cut sections in the process of being burned in the combustion chamber. The combustion chamber is relatively narrow in width measured from the expanded metal panel or grill to the opposing panel assembly and is therefore designed to receive cross-cut log sections or cross-cut sections of pressed wood logs therein of an axial extent less than one-half the diameter of the cross-cut sections of solid fuel placed within the combustion chamber. By burning cross-cut wood log sections or cross-cut pressed wood log sections in this manner ample oxygen is supplied to the burning fuel to support complete combustion and the pressed wood log sections and conventional wood log sections burned within the combustion chamber are substantially reduced to a fine ash residue.

The main object of this invention is to provide a simple and efficient combustion chamber for use within a fireplace enclosure or the like and in which solid fuel components may be efficiently and substantially completely burned for maximum output of heat.

Another object of this invention is to provide a combustion chamber which may be readily manufactured in different sizes so as to be accommodated in different sizes of fireplace enclosures.

Still another object of this invention is to provide a combustion chamber in which a variety of solid fuel members may be burned with high efficiency.

Still another important object of this invention is to provide a combustion chamber constructed in a manner which will greatly facilitate the ignition of combustible solid fuel therein.

A final object of this invention to be specifically enumerated herein is to provide a fuel holder for fireplaces in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
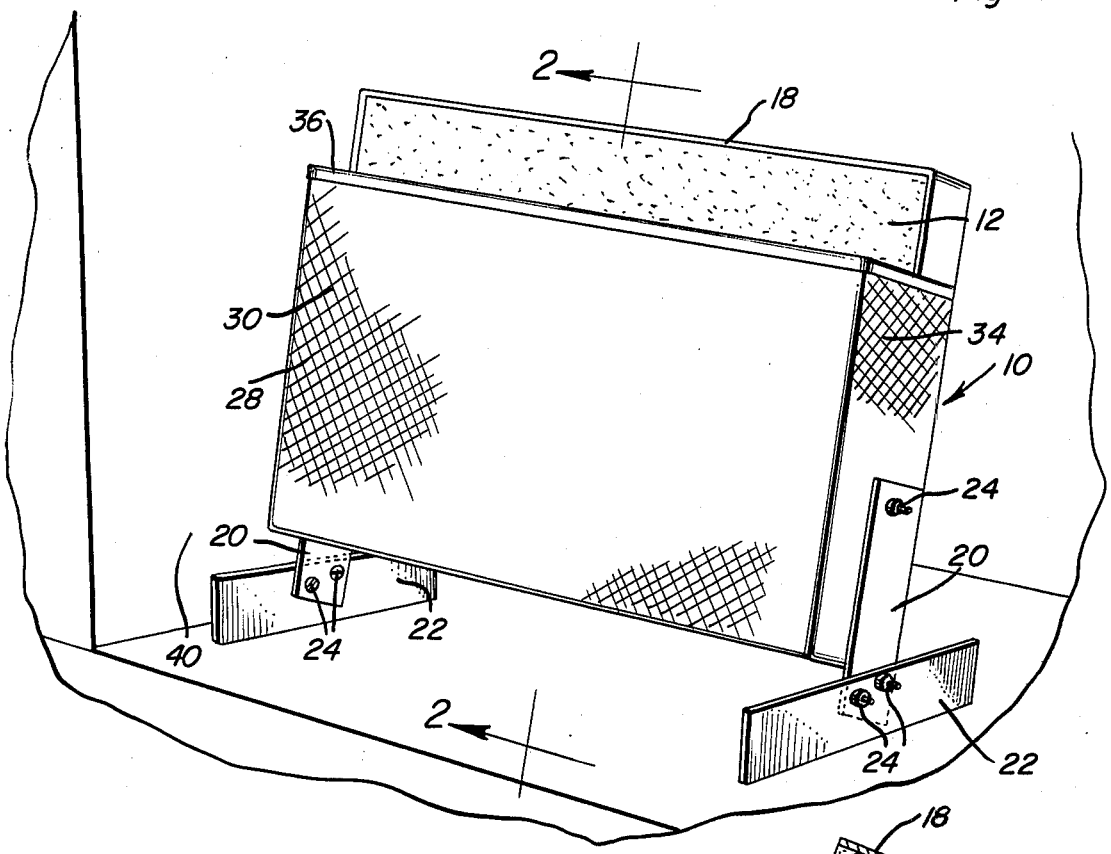
FIG. 1 is a perspective view of the fuel holder disposed within a conventional fireplace opening.
Figure 3:
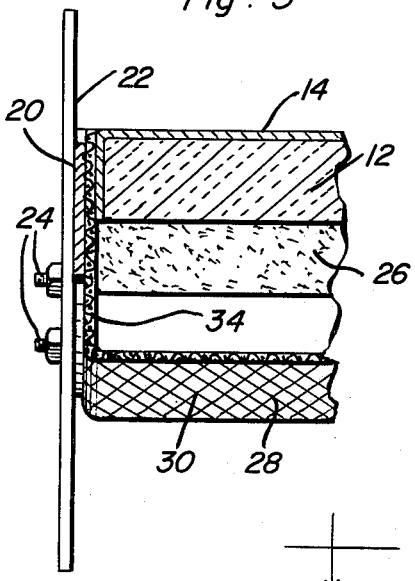
FIG. 3 is an enlarged fragmentary horizontal sectional view taken substantially upon the plane indicated by the sectional line 3—3 of FIG. 2.
Figure 2:
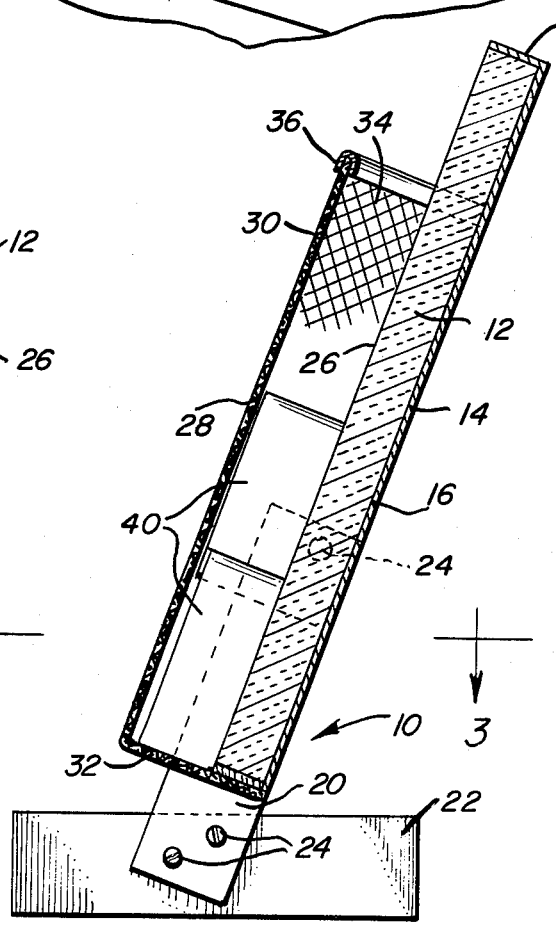
FIG. 2 is an enlarged fragmentary vertical sectional view taken substantially upon the plane indicated by the section line 2—2 of FIG. 1.

Referring now more specifically to the drawings, the numeral 10 generally designates the fuel holder of the instant invention. The holder 10 comprises an upstanding panel 12 constructed of any suitable fireproof and heat reflective material. The panel 12 includes a protective and decorative panel 14 secured over its rear surface 16 and the panel 14 includes right angulated marginal portions 18 which embrace the top, bottom and opposite side marginal portions of the panel 12.

A pair of leg defining metal straps 20 are secured at their upper ends to opposite side portions of the panel 12 by fasteners 24 and at their lower ends to horizontally disposed edge upstanding foot defining metal straps 22 by fasteners 24 secured through the straps 20 and 22. The panel 12 includes a front face 26 and a grill 28 is supported from the panel 12 and includes a main panel portion 30 which generally parallels and is spaced forward of the front face 26 of the panel 12. The grill 28 also includes right angulated bottom and opposite side marginal portions 32 and 34 which extend rearwardly from the main panel portion 30 and are secured in overlying relation to the adjacent bottom and opposite side marginal portions 18 of the panel 14, the upper marginal edges of the main panel portion 30 and opposite side marginal portions 34 being capped by a decorative strip 36.

The straps 20 and 22 as well as the panel 14 may be constructed of 18–20 gauge sheet metal and the grill 28 may be constructed of 8–20 gauge expanded sheet steel.

The spacing between the main panel portion 30 and the front face 26 of the panel 12 may be between $1\frac{1}{2}$ and $2\frac{1}{2}$ inches, but it is preferable that the spacing between the main portion 30 and the panel 12 be on the order of 2 inches.

Various types of solid fuel may be burned within the upwardly opening combustion chamber defined between the main panel portion 30 and the panel 12. Preferably, 1-inch to 2-inch thickness cross-cut sections 40 of pressed wood fiber logs will be utilized as fuel within the combustion chamber of the holder 10. Such logs are marketed under the names "Presto Logs" and "Nord Logs". When these types of cross-cut log sections are burned within the holder, combustion thereof is so complete as to reduce the logs to fine ash. However, conventional cross-cut log sections may also be burned within the holder, and it is also possible to burn other solid fuels such as charcoal and coal, although the use of cross-cut log sections is desirable. The holder may be placed within a conventional fireplace opening such as that designated by the numeral 40 in FIG. 1 and the by-products of combustion may be exhausted upwardly through the conventional fireplace chimney outlet. Also, the holder may be utilized within the newer truncated cone-shaped suspended and free standing metal fireplace structures as well as other similar structures.

In either fireplaces or similar structures the panel 12 serves to reflect the heat of fuel being burned forward of the panel in a direction normal to the panel and to reduce, to a minimum, rearward conduction of heat through and rearward of the panel 12. Accordingly, although some heat loss is experienced outward of the side marginal portions of the grill 28, this minimal loss of heat is necessary to provide the required combustion air draft and a maximum amount of usable heat is reflected forward of the panel 12.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with cross-cut slices of log fuel of generally the same thickness, a fireplace heater including an upstanding substantially planar inclined panel assembly having a forwardly and upwardly facing front side and upper and lower marginal edges interconnected at corresponding ends by opposite side marginal edges, said panel assembly being constructed of fireproof heat reflective material, a grill assembly paralleling said panel assembly and stationarily supported relative to the latter in spaced relation forward of said front side to define a narrow combustion chamber between said grill and panel assembly of a front-to-rear depth only slightly greater than the thickness of said slices, said grill including foraminated lower and opposite side marginal portions extending between corresponding lower and side marginal edges of said grill and panel assembly, thereby closing the lower and opposite side marginal portions of said combustion chamber, the upper marginal portion of said panel assembly projecting appreciably above the upper marginal portion of said grill and defining an upper inclined extension of said panel assembly above said grill, thereby enabling cross-cut pressed log sections to be more readily positioned and guided for downward dropping into said combustion chamber, said combustion chamber opening upwardly between the upper marginal portions of said grill and panel assembly and in a direction paralleling said extension and panel assembly, said slices of log fuel being positionable upon said extension for downward guided sliding therealong between said upper marginal portions into said combustion chamber for gravity edge-to-edge stacking within said combustion chamber, said panel assembly, grill and combustion chamber being slightly rearwardly and upwardly inclined, said heater including lower foot means for supporting said heater from a fireplace hearth with said panel assembly maintained in the aforementioned inclined position.

2. The combination of claim 1 wherein said grill is constructed of an expanded metal sheet.

3. The combination of claim 2 wherein said lower and side marginal portions of said grill comprise integral angularly displaced portions of said expanded metal sheet.

4. The method of efficiently burning log wood in a narrow combustion chamber having one open side defined by a foraminous panel, a rear side closed by an upstanding heat resistant and reflective support panel assembly and a foraminous bottom extending between lower marginal portions of said foraminous panel and panel assembly and with one side surface of said support panel assembly facing outwardly of said open side, paralleling said foraminous panel and inclined rearwardly and upwardly; edgewise dropping a plurality of cross-cut log sections of an axial thickness less than one-half the diameter thereof downwardly across said support panel assembly for positioning said sections in edge-to-edge positions spaced across the lower marginal portion of said panel assembly upon said foraminous bottom and in vertically stacked relation upwardly along said one side surface, and igniting the lower sections in said combustion chamber.

* * * * *